US006250096B1

(12) United States Patent
Bonaquist et al.

(10) Patent No.: US 6,250,096 B1
(45) Date of Patent: Jun. 26, 2001

(54) METHOD FOR GENERATING A COLD GAS

(75) Inventors: Dante Patrick Bonaquist, Grand Island; Harry Cheung, Williamsville; Arun Acharya, East Amherst, all of NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 09/561,963

(22) Filed: May 1, 2000

(51) Int. Cl.[7] ..... F25D 9/00; F25B 9/00
(52) U.S. Cl. ..... 62/401; 62/88; 62/402
(58) Field of Search ..... 62/401, 402, 86, 62/87, 88

(56) References Cited

U.S. PATENT DOCUMENTS

| | | | | |
|---|---|---|---|---|
| 2,030,509 | * | 2/1936 | Frankl | 62/85 |
| 3,856,493 | * | 12/1974 | Bulkley | 62/401 |
| 4,924,677 | * | 5/1990 | Quack | 62/87 |
| 5,392,606 | * | 2/1995 | Labinov et al. | 60/673 |

* cited by examiner

*Primary Examiner*—William Doerrler
(74) *Attorney, Agent, or Firm*—Stanley Ktorides

(57) ABSTRACT

A method for generating refrigeration for application to a heat load, especially at very cold temperatures, using an environmentally benign working gas such as air and using an upstream precooling circuit to reduce or eliminate inefficiencies stemming from warm end pinch.

5 Claims, 3 Drawing Sheets

METHOD FOR GENERATING A COLD GAS

TECHNICAL FIELD

This invention relates generally to the provision of refrigeration and is particularly useful for the provision of refrigeration at a very cold temperature.

BACKGROUND ART

Historically, refrigeration systems have used various fluorocarbons and hydrofluorocarbons as refrigerant fluids to generate refrigeration and to provide the refrigeration to a heat load. Recently the use of some such refrigerants has been questioned on environmental and other grounds. Systems which use an environmentally friendly working fluid, such as air, are known. However, such systems typically are less efficient than systems using the more conventional refrigerants. For example, air systems commonly have a pinch at the warm end of the heat exchanger used in the system which limits the refrigeration capacity of the system. This is particularly a problem when the provision of the refrigeration is desired at a very cold temperature.

Accordingly it is an object of this invention to provide an improved method for generating a cold gas for the provision of refrigeration.

It is another object of this invention to provide an improved method for generating a cold gas for the provision of refrigeration which employs an environmentally benign working fluid.

It is a further object of this invention to provide an improved method for generating a cold gas for the provision of refrigeration which employs an environmentally benign working fluid and can efficiently provide the refrigeration at a very cold temperature.

SUMMARY OF THE INVENTION

The above and other objects, which will become apparent to those skilled in the art upon a reading of this disclosure, are attained by the present invention, one aspect of which is:

A method for generating a cold gas for supplying refrigeration comprising:

(A) compressing a nitrogen-containing working gas and cooling the compressed nitrogen-containing working gas;

(B) expanding the cooled nitrogen-containing working gas to produce a cold nitrogen-containing working gas, and warming the cold nitrogen-containing working gas to supply refrigeration to a heat load;

(C) further warming the nitrogen-containing working gas by indirect heat exchange with the compressed nitrogen-containing working gas to effect a portion of said cooling of the compressed nitrogen-containing working gas; and (D) compressing a refrigerant fluid, expanding the compressed refrigerant fluid to cool the refrigerant fluid, and warming the cooled refrigerant fluid by indirect heat exchange with the compressed nitrogen-containing working gas to effect another portion of said cooling of the compressed nitrogen-containing working gas.

Another aspect of the invention is:

A method for generating a cold gas for supplying refrigeration comprising:

(A) compressing a nitrogen-containing working gas and cooling the compressed nitrogen-containing working gas;

(B) expanding the cooled nitrogen-containing working gas to produce a cold nitrogen-containing working gas;

(C) warming a first portion of the cold nitrogen-containing working gas to supply refrigeration to a heat load; and (D) warming a second portion of the cold nitrogen-containing working gas by indirect heat exchange with the compressed nitrogen-containing working gas to effect said cooling of the compressed nitrogen-containing working gas.

As used herein the term "very cold temperature" means a temperature within the range of from −30° F. to −300° F.

As used herein the term "nitrogen-containing working gas" means a gas having a nitrogen concentration of at least 78 mole percent.

As used herein the term "expansion" means to effect a reduction in pressure.

As used herein the term "refrigeration" means the capability to reject heat from a subambient temperature system.

As used herein the terms "turboexpansion" and "turboexpander" mean respectively method and apparatus for the flow of high pressure fluid through a turbine to reduce the pressure and the temperature of the fluid thereby generating refrigeration.

As used herein the term "refrigerant fluid" means a pure component or mixture used as a working fluid in a refrigeration process which undergoes changes in temperature, pressure and possibly phase to absorb heat at a lower temperature and reject it at a higher temperature.

DETAILED DESCRIPTION

Figure 1:
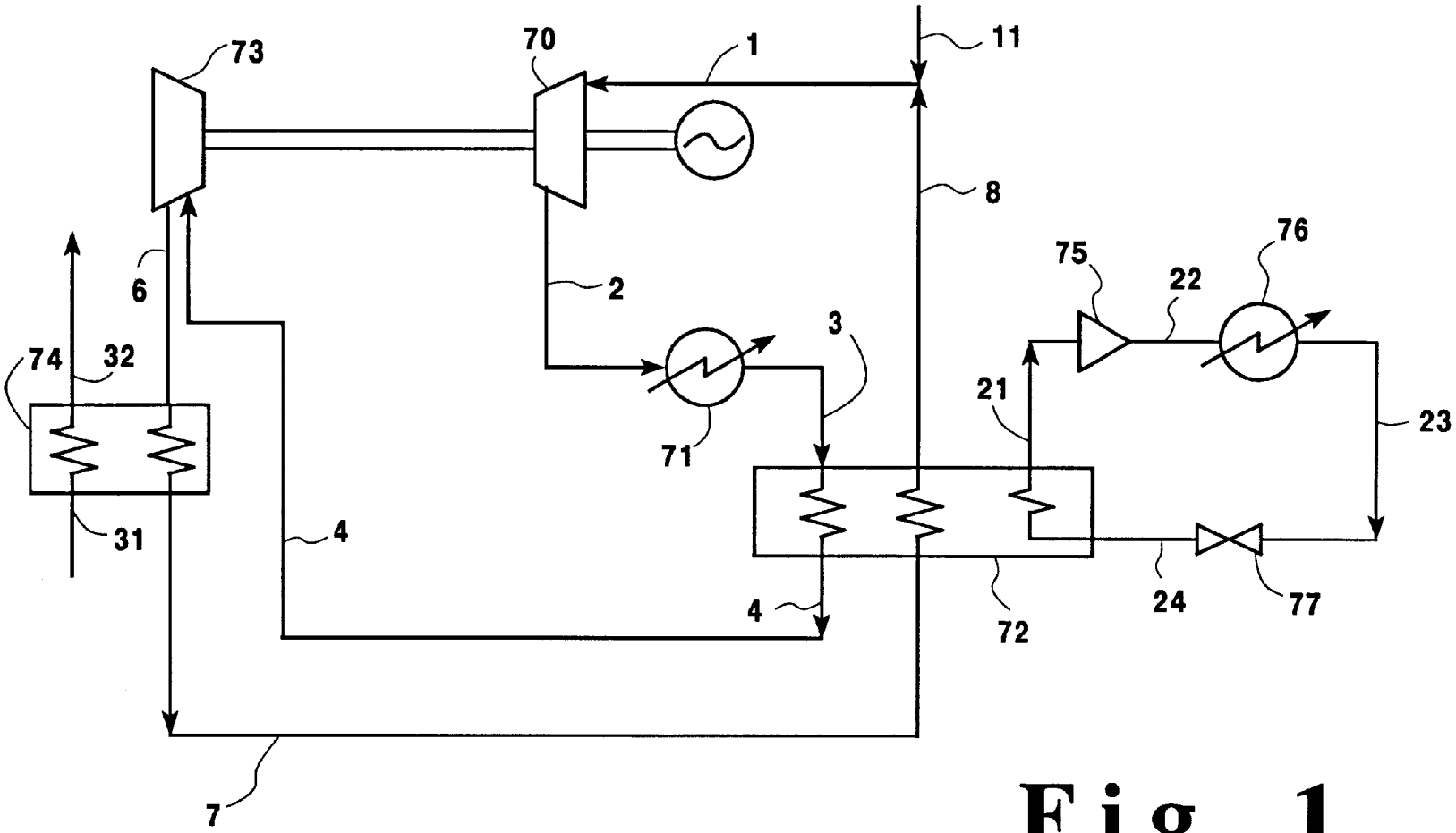
FIG. 1 is a schematic representation of one preferred embodiment of the invention employing a precooler system.

The invention will be described in detail with reference to the Drawings. Referring now to FIG. 1, nitrogen-containing working gas 1 is passed to compressor 70 wherein it is compressed to a pressure generally within the range of from 100 to 1500 pounds per square inch absolute (psia). Preferably the nitrogen-containing working gas is air or nitrogen gas having a nitrogen concentration exceeding that of air up to 99 mole percent or more. In the practice of this invention it is important that the nitrogen-containing working gas be substantially free of high boiling impurities such as water vapor and carbon dioxide. The working gas may be passed through a purifier, such as a molecular sieve adsorbent purifier, to ensure that it is cleaned of such high boiling impurities. Resulting compressed nitrogen-containing working gas 2 is cooled of the heat of compression by passage through cooler 71 and then passed as gas stream 3, generally at about ambient temperature, to heat exchanger 72. As the nitrogen-containing working gas passes through heat exchanger 72 it is cooled by indirect heat exchange with two different warming fluids, as will be more fully described below, to produce cooled, compressed nitrogen-containing working gas 4, having a temperature generally within the range of from 300 to 150K.

Cooled, compressed nitrogen-containing working gas 4 is expanded, such as by passage through turboexpander 73, to a pressure generally within the range of from 15 to 1000 psia, to generate refrigeration and to produce cold nitrogen-containing working gas 6 having a temperature generally within the range of from 100 to 250K. The cold nitrogen-containing working gas is warmed to supply refrigeration to a heat load. In the embodiment illustrated in FIG. 1, cold gas 6 is passed to heat load heat exchanger 74 wherein it is warmed by indirect heat exchange with fluid 31 to produce cooled fluid 32 and warmed nitrogen-containing working gas 7. Representative examples of heat loads for use in the practice of this invention include cooling and/or freezing of foods, cooling a vapor stream for the purpose of condensing volatile organic compounds, and absorbing heat from a low temperature heat transfer fluid.

Nitrogen-containing working gas 7 is then passed to heat exchanger 72 wherein it is further warmed to supply a portion of the cooling necessary to cool the working gas to the temperature of gas 4. Resulting further warmed nitrogen-containing working gas 8 is then recycled back to compressor 70 in stream 1 and the cycle repeats. If necessary, make up gas 11, which is substantially free of high boiling impurities, may be added to the feed into compressor 70 to compensate for system losses.

Refrigerant fluid 21 is compressed to a pressure generally within the range of from 50 to 500 psia by passage through compressor 75. Any effective refrigerant fluid may be used in the practice of this invention. Examples include ammonia, R-410A, R-507A, R-134A, propane, R-23 and mixtures such as mixtures of fluorocarbons, hydrofluorocarbons, hydrochlorofluorocarbons and/or hydrocarbons.

Compressed refrigerant fluid 22 is cooled of the heat of compression by passage through cooler 76 and resulting refrigerant fluid 23 is expanded through valve 77 to generate refrigeration and produce cooled refrigerant fluid 24 having a temperature generally within the range of from 150 to 300K. Cooled refrigerant fluid 24 is then warmed by passage through heat exchanger 72 to provide another portion of the cooling necessary to cool the working gas to the temperature of gas 4. The resulting warmed refrigerant fluid then passes as stream 21 to compressor 75 and the cycle repeats. Although FIG. 1 illustrates the heat exchange of the cooling nitrogen-containing working gas with the warming working gas and the warming refrigerant fluid as occurring in the same heat exchanger, those skilled in the art will recognize that this cooling could take place using different heat exchangers. The use of the precooling circuit employing the recirculating refrigerant fluid serves to reduce or eliminate the warm end pinch enabling efficient downstream generation of very cold temperature refrigeration using an environmentally friendly working gas.

Figure 2:
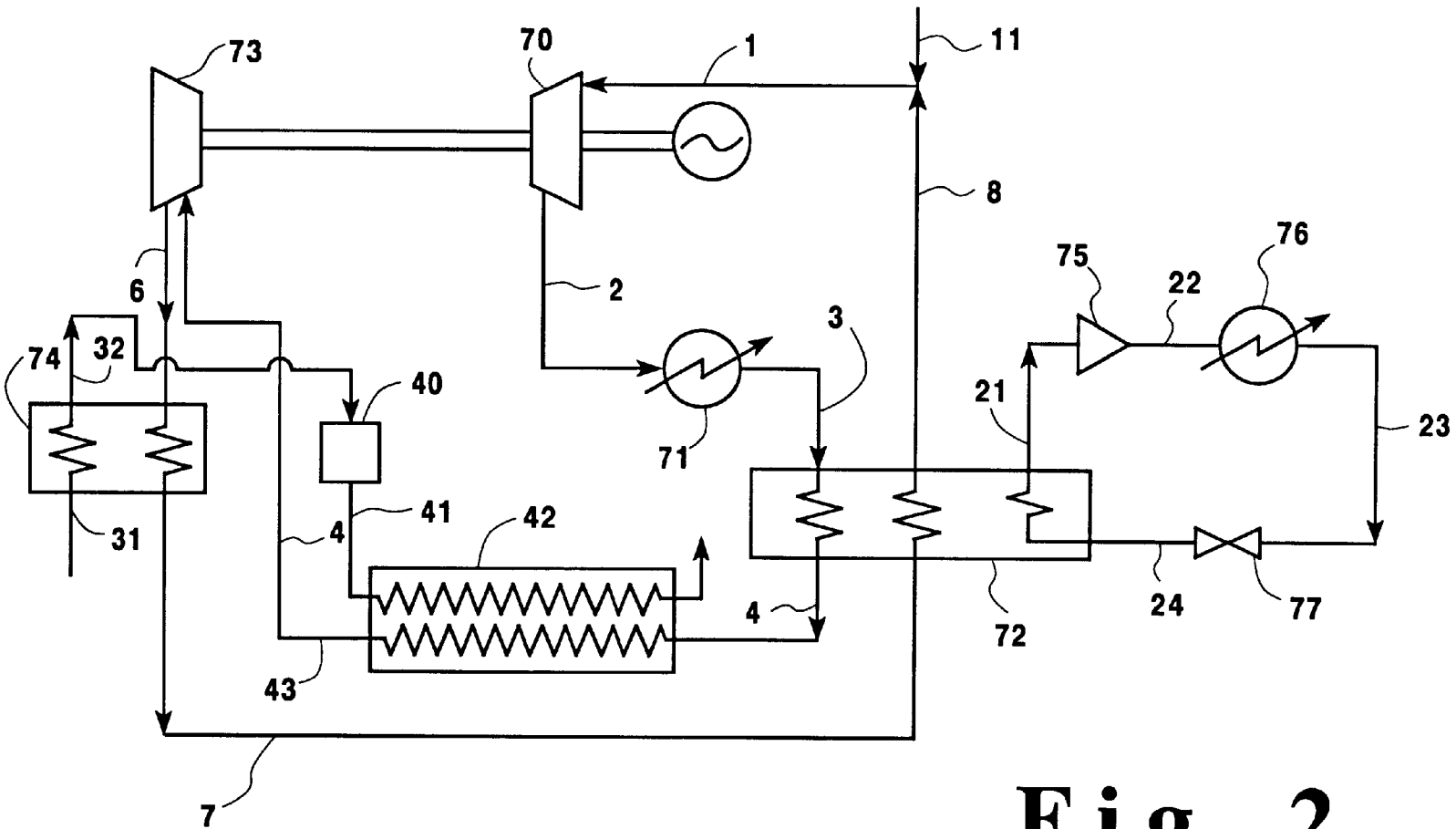
FIG. 2 is a schematic representation of another preferred embodiment of the invention wherein the cooled, compressed nitrogen-containing gas is further cooled prior to expansion.

FIG. 2 illustrates a preferred embodiment of the system illustrated in FIG. 1 wherein the cooled working gas is further cooled prior to the expansion. The numerals in FIG. 2 are the same as those of FIG. 1 for the common elements, and these common elements will not be described again in detail Referring now to FIG. 2, cooled fluid 32 is passed to freezer 40 wherein it serves to cool and/or freeze articles. Resulting fluid 41, which still retains significant refrigeration is passed through heat exchanger 42 wherein it is warmed by indirect heat exchange with cooled, compressed nitrogen-containing working gas 4 to produce further cooled, compressed nitrogen-containing working gas 43 for passage to turboexpander 73 and for further processing as previously described with reference to FIG. 1. Generally, in the practice of the invention in accord with the embodiment illustrated in FIG. 2, the cooled, compressed nitrogen-containing working gas has a temperature generally within the range of from 300 to 150K, and the further cooled, compressed nitrogen-containing working gas has a temperature generally within the range of from 100 to 250K.

Figure 3:
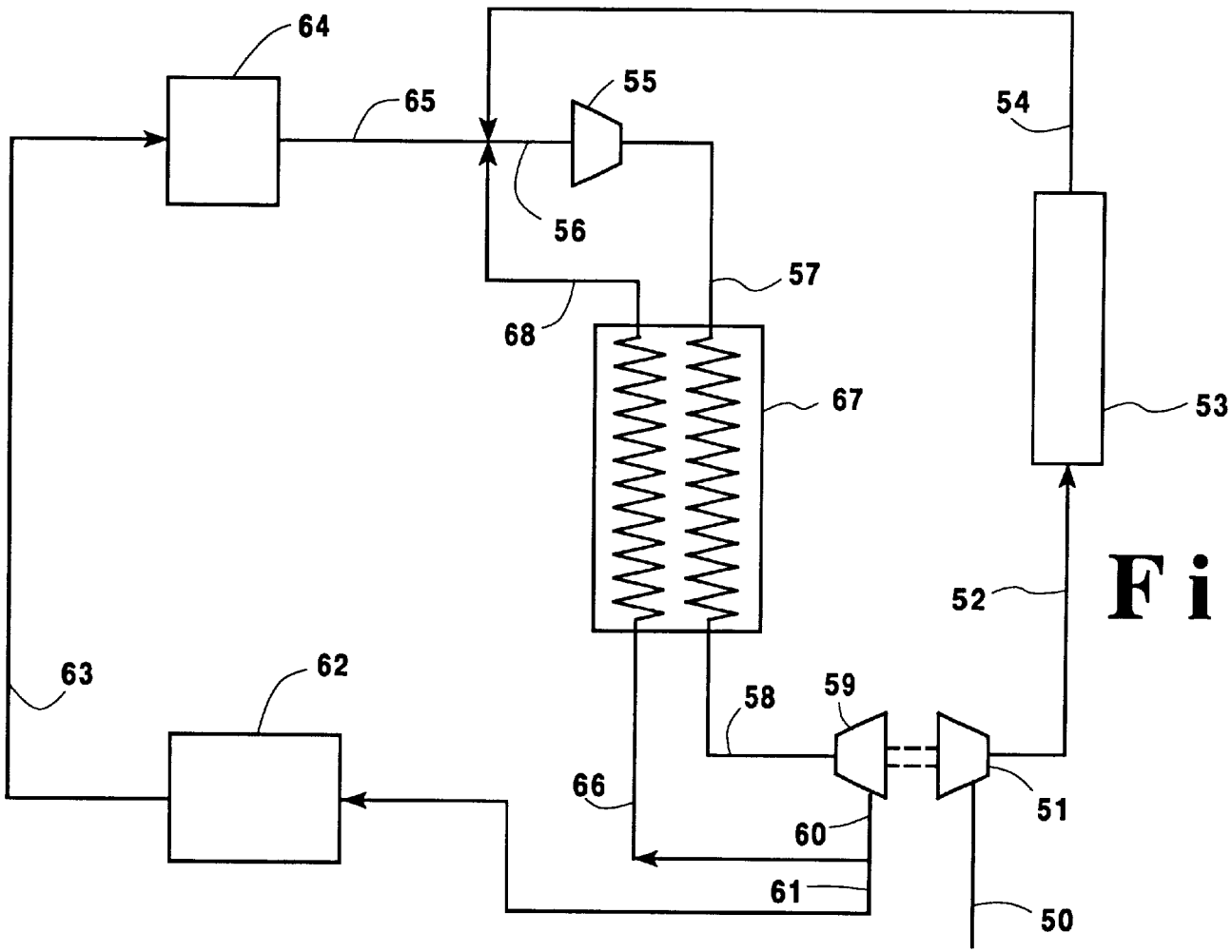
FIG. 3 is a schematic representation of another preferred embodiment of the invention wherein a portion of the expanded cold nitrogen-containing working gas is used to carry out the precooling of the working gas.

FIG. 3 illustrates another embodiment of the invention wherein a portion of the cold nitrogen-containing working gas is used to carry out the precooling of the working as prior to the turboexpansion. Referring now to FIG. 3, nitrogen-containing working gas 50, e.g. air, is passed to compressor 51 wherein it is compressed to a pressure generally within the range of from 50 to 250 psia. Resulting compressed nitrogen-containing working gas 52 is passed to membrane unit 53 wherein its nitrogen concentration is increased and wherein high boiling impurities such as carbon dioxide and water vapor are removed. Resulting increased concentration nitrogen-containing working gas 54 is passed to recycle compressor 55 as part of recycle compressor input stream 56. Within recycle compressor 55 the nitrogen-containing working gas is compressed to a pressure generally within the range of from 50 to 1500 psia to form compressed working gas stream 57 for input to heat exchanger 67.

Within heat exchanger 67 the compressed nitrogen-containing working gas is cooled to form cooled, compressed nitrogen-containing working gas 58 which is expanded through turboexpander 59 to generate refrigeration and to produce cold nitrogen-containing working gas 60. A first portion 61 of cold nitrogen-containing working gas 60 is warmed to supply refrigeration to a heat load. In the embodiment of the invention illustrated in FIG. 3 the heat load is freezer 62. The resulting warmed nitrogen-containing working as 63 is then cleaned by passage through purifier 64 and resulting purified nitrogen-containing working gas 65 is combined with other streams to form stream 56 for passage to recycle compressor 55.

A second portion 66 of cold nitrogen-containing working gas 60 is warmed by passage through heat exchanger 67 by indirect heat exchange with the compressed nitrogen-containing working gas 57 to effect the precooling of the nitrogen-containing working gas prior to the turboexpansion of the nitrogen-containing working gas to generate the cold gas. The resulting warmed second portion 68 is then combined with other nitrogen-containing gas streams to form recycle compressor input stream 56 which is processed as was previously described. Generally second portion 66 comprises from 5 to 50 percent of cold nitrogen-containing working gas 60. If desired, nitrogen-containing working gas 63 may be passed through the warm end portion of heat exchanger 67 to provide further precooling of stream 57, with the resulting further warmed nitrogen-containing working gas 63 then passed to purifier 64.

With the use of this invention wherein precooling of the working fluid, using either an exogeneous circuit or a recycle circuit, prior to the expansion of the working fluid to generate the cold gas, a nitrogen-containing environmentally friendly working fluid may be used while mitigating to a large extent the process inefficiencies heretofore experienced with the use of such fluids, especially when the refrigeration is supplied to a heat load at a very cold temperature.

Although the invention has been described in detail with reference to certain preferred embodiments, those skilled in the art will recognize that there are other embodiments of the invention within the spirit and the scope of the claims.

What is claimed is:

1. A method for generating a cold gas for supplying refrigeration comprising:

(A) compressing a nitrogen-containing working gas and cooling the compressed nitrogen-containing working gas;

(B) expanding the cooled nitrogen-containing working gas to produce a cold nitrogen-containing working gas, and warming the cold nitrogen-containing working gas to supply refrigeration to a heat load;

(C) further warming the nitrogen-containing working gas by indirect heat exchange with the compressed nitrogen-containing working gas to effect a portion of said cooling of the compressed nitrogen-containing working gas; and (D) compressing a refrigerant fluid, expanding the compressed refrigerant fluid to cool the refrigerant fluid, and warming the cooled refrigerant fluid by indirect heat exchange with the compressed nitrogen-containing working gas to effect another portion of said cooling of the compressed nitrogen-containing working gas.

2. The method of claim 1 wherein the nitrogen-containing working gas is air.

3. The method of claim 1 wherein the nitrogen-containing working gas is nitrogen gas.

4. The method of claim 1 wherein the refrigeration is supplied to the heat load at a very cold temperature.

5. The method of claim 1 wherein the cooled, compressed nitrogen-containing working gas is further cooled prior to the expansion to produce the cold nitrogen-containing working gas.

* * * * *